US007779758B2

(12) United States Patent
Wintersgill et al.

(10) Patent No.: US 7,779,758 B2
(45) Date of Patent: Aug. 24, 2010

(54) INK RECOVERY SYSTEM WITH SHUTTLE MEMBER

(75) Inventors: Stephen Wintersgill, Lancashire (GB); John Robinson, Lancashire (GB); David William Burke, Cheshire (GB); Antony Whiteside, Rochdale (GB)

(73) Assignee: Absolute Engineering, Limited, West Yorkshire (GB)

( * ) Notice: Subject to any disclaimer, the term of this patent is extended or adjusted under 35 U.S.C. 154(b) by 614 days.

(21) Appl. No.: 11/576,222

(22) PCT Filed: Sep. 27, 2005

(86) PCT No.: PCT/GB2005/003713

§ 371 (c)(1),
(2), (4) Date: Mar. 28, 2007

(87) PCT Pub. No.: WO2006/035217

PCT Pub. Date: Apr. 6, 2006

(65) Prior Publication Data

US 2007/0289464 A1 Dec. 20, 2007

(30) Foreign Application Priority Data

Sep. 28, 2004 (GB) ..... 0421483.9

(51) Int. Cl.
*B41F 31/00* (2006.01)

(52) U.S. Cl. ..... 101/350.6; 101/350.1; 101/366; 101/DIG. 34

(58) Field of Classification Search ..... 101/350.6, 101/DIG. 34
See application file for complete search history.

(56) References Cited

U.S. PATENT DOCUMENTS

| | | | | | |
|---|---|---|---|---|---|
| 1,401,218 | A | * | 12/1921 | Weldon | 101/364 |
| 1,447,849 | A | * | 3/1923 | Hough | 366/136 |
| 1,509,888 | A | * | 9/1924 | Weldon | 101/364 |
| 3,196,784 | A | * | 7/1965 | Kraft | 101/123 |
| 3,596,595 | A | * | 8/1971 | Zimmer et al. | 101/120 |

(Continued)

FOREIGN PATENT DOCUMENTS

EP 0 955 164 A1 11/1999

(Continued)

*Primary Examiner*—Jill E Culler
(74) *Attorney, Agent, or Firm*—Woodard Emhardt Moriarty McNett & Henry, LLP

(57) ABSTRACT

A system to remove most or substantially all of the residual ink from an ink chamber prior to post print washing, said ink chamber comprising an ink chamber profile provided with a space for ink, at least one inlet and at least one outlet, and with upper and lower doctor blade members detachably mounted on the ink chamber profile, said blades bounding an opening which, in operation, faces and engages with the outer circumference of an engraved cylinder and which extends over the length of the ink chamber profile, the ink chamber profile being sealed at its extremities by flexible seals, said ink chamber profile, end seals, doctor blades and engraved cylinder demarcating an ink cavity, characterized in that there is further provided a shuttle member within the ink cavity, said shuttle member being movable substantially along the entire length of the ink chamber profile in order to aid purging of residual ink from said ink cavity, said shuttle member further being provided with associated drive means to induce movement within said ink cavity.

13 Claims, 5 Drawing Sheets

U.S. PATENT DOCUMENTS

| | | | | |
|---|---|---|---|---|
| 4,461,210 | A | | 7/1984 | MacPhee et al. |
| 4,667,595 | A | | 5/1987 | Geretzki |
| 5,125,341 | A | * | 6/1992 | Yaeso ..... 101/367 |
| 5,150,651 | A | * | 9/1992 | Flores ..... 101/207 |
| 6,095,045 | A | * | 8/2000 | Petersen et al. ..... 101/350.6 |

FOREIGN PATENT DOCUMENTS

| | | | |
|---|---|---|---|
| EP | 0 725 734 | B1 | 11/2000 |
| EP | 1 405 721 | A | 4/2004 |

* cited by examiner

INK RECOVERY SYSTEM WITH SHUTTLE MEMBER

CROSS-REFERENCE TO RELATED APPLICATIONS

This application is the U.S. National Stage of International Application No. PCT/GB2005/003713 filed Sep. 27, 2005, which claims priority to GB Application No. 0421483.9 filed Sep. 28, 2004, both of which are hereby incorporated in their entirety.

BACKGROUND OF THE INVENTION

The present invention relates to a liquid recovery system for industrial coating and printing machinery, more specifically, printing presses such as offset gravure or Flexographic printing presses, more specifically, to those printing presses which incorporate an ink chamber system.

DESCRIPTION OF THE PREFERRED EMBODIMENT

For reasons of clarity, the description contained herein will refer solely to web fed printing devices, however, it is recognised that the matter of the present invention is equally applicable to sheet fed printing devices, and its use therein is encompassed within the scope of the present invention.

In Flexographic (relief) or Gravure (intaglio, engraved) printing processes, a print image carries a metered quantity of ink which is then transferred to a moving substrate by impression against a backing cylinder.

In Flexographic printing, the ink is applied uniformly (metered) to the surfaces of rotating cylinders by an Anilox roll, which is then transferred to the surface of an adjacent, counter rotating print cylinders which describe the image, and then ultimately onto the surface of a moving substrate, said moving substrate running between the print cylinder and a backing or impression cylinder. In gravure printing, the ink is delivered directly to the engraved surface of the print cylinder, which then meters the ink and describes the image at the same time. The substrate carrying the image is then moved into a drying or curing area, wherein said image is made fast. In a UV cured system, the substrate and image are exposed to ultra-violet radiation, typically from an array of UV lamps, which cure the ink, leaving a permanent image on the substrate. In other ink systems, the substrate carrying the image is exposed to heat or infra-red radiation, typically from heaters, IR lamps, hot air flows etc. . . . , said heat/IR evaporating the carrier solvent from the ink, again leaving a permanent image upon the substrate.

In either process, the creation of a precisely metered film of ink is achieved by the presence of a roll surface which is engraved with a plurality of cells, those cells being thoroughly irrigated with ink, and then removing the excess (all ink not dwelling within the cell confines) by squeezing off with an adjacent rubber roller, or alternatively scraping off with a knife edge, known generally as a doctor blade.

An ink chamber is a commonly used device for the application of ink to the engraved cylinder, comprising a long, regular and generally channel shaped structure into which a pair of doctor blades are mounted, the doctor blades engage the surface of the engraved cylinder and form a portion of the upper and lower walls of an enclosed ink cavity. The ends of the chamber are enclosed by a flexible seal arrangement.

Figure 1:
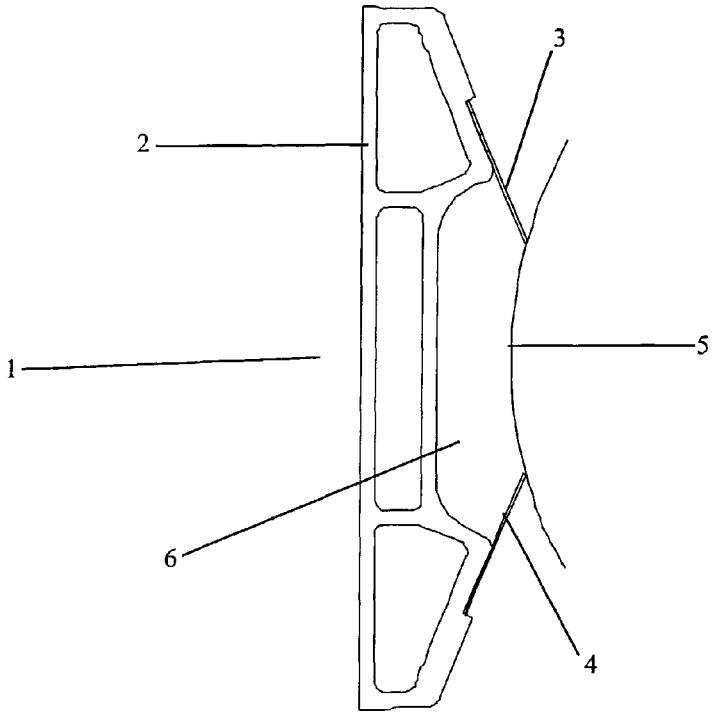
FIG. 1 is a sectioned side view of a standard ink chamber.

A standard ink chamber is herein described for reference purposes. Referring initially to FIG. 1, the ink chamber 1 comprises an ink chamber profile 2, typically constructed from either aluminium or carbon fibre, with respective upper and lower doctor blades 3, 4, typically made of nylon or flexible steel strips. The aforementioned, in conjunction with a segment of the circumference of an engraved cylinder, 5 forming an ink cavity 6. The ends of the ink cavity are enclosed by flexible end seals (not shown), typically constructed of polyurethane foam or rubber based materials, allowing a degree of flexibility to accommodate the changing shape of the ink cavity resulting from wear of the doctor blades.

Figure 2:
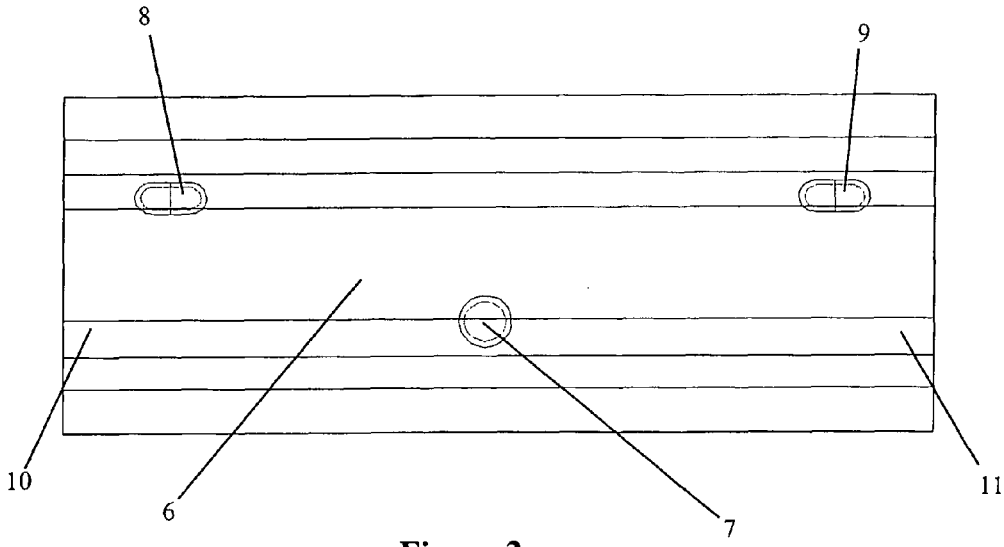
FIG. 2 is a schematic representation of a rear view of the chamber of FIG. 1.

Referring now to FIG. 2, ink is delivered to the ink chamber 6 through an inlet 7. As the level of ink in the ink cavity 6 rises, excess ink is drained away via overflow outlets 8, 9. This arrangement ensures a plentiful supply of ink to the ink cavity, ensuring thorough cell irrigation.

When a machine is required to be shut down, or when a colour change is desired, the ink supply to inlet 7 is shut off and ink is allowed to drain (either by gravity or a pumped system) back through the inlet 7. Due to the inherent viscosity of printing ink, the draining process is both time consuming and inefficient, leaving large amounts of ink remaining in the chamber, particularly proximal the ends of the ink cavity 10, 11. A further problem with this arrangement is that during a print run, it is important that the homogeneity of the ink be maintained and that solids are not allowed to separate out, thus it is common practice for a greater quantity of ink to be supplied to the chamber than is required for printing, the excess draining away via the overflow outlets 8,9, this maintains a degree of ink movement, however, it will be readily apparent that there is a tendency for dead zones (areas of low ink movement or turbulence) to develop towards the ends of the ink cavity 6, especially towards the bottom of the chamber 10, 11.

During the shut down/colour change operation, clean up of ink is a tedious, wasteful, expensive, environmentally challenging, and often time consuming process, unused ink having to be drained from the ink chamber back into the ink supply container and the ink chamber then having to be thoroughly cleaned with solvent prior to re-use.

Following draining of the ink chamber system, there is inevitably a portion of residual ink retained within the ink cavity, this is washed out with the appropriate solvent for the ink system in use (cleaning water, thinners, etc), which can then not be disposed of down a surface drain, due to potential environmental impact. Solvents must be separated out from the wash down waste, prior to disposal of residual ink solids (landfill sites), said solids must be filtered out of the wash down waste until it meets various standards of decontamination.

The cost impact here is twofold, firstly a large amount of ink is wasted at every ink changeover (even in one of the more efficient naturally draining chamber systems up to 2.5 Kg of ink can be wasted in a 2.5 m wide chamber) this waste ink can generate 12.5 kgs of wash down waste, which must then be treated to the satisfaction of government/environmental agencies prior to disposal of both solid waste and solvent. As landfill taxes and other environmental safeguards increase, this is becoming an ever higher cost issue for print companies.

The problem of waste ink and also the time taken to change colour at a print station (partly due to the amounts of ink retained in the chamber) has been recognised within the industry for some time and attempts have been made to tackle the problem, however, the two most pertinent systems, outlined below, have their own problems.

EP 0,955,164 (MARQUIP) describes an ink chamber system which comprises a chamber divided by a flexible bladder. Pressure is applied to the rearward surface of the flexible bladder, which then expands into the ink chamber system, thereby expelling unused ink. The drawbacks of this system relate to the bladder itself, and will be readily apparent to one skilled in the art. Firstly, in order to fully expunge ink from the chamber, the bladder must eventually come into intimate contact with the still rotating engraved cylinder, the surface of which will quickly erode the surface of the bladder, which would therefore require regular replacement, slowing down the changeover from one colour to another. Further to this, the environment within an ink chamber is surprisingly hostile, particularly where solvent (as opposed to water) based inks are being utilised. In this environment rubber and synthetic flexible materials are quickly corroded, becoming brittle and unable to fulfil the required function. Even in the instance where there is no damage to the bladder while an ink change is being performed, the bladder would need to be checked to verify its integrity, so as to avoid the risk of ink ingress into the bladder pressurisation system, this would again cause undue delays in a standard colour change for a print run. A further problem exists whereby, if the bladder is inflated to a sufficient pressure in order to expand aggressively into all contours and corners of the chamber, the pressure exerted on the surface of the engraved roll would be significant, the resultant force causing or encouraging separation of the chamber from the surface of the engraved roll, leading to potential ink leakage.

EP 0,725,734 (PRINTING PRESS SERVICES) describes a system for effecting rapid colour changes in a printing machine. The ink supply system of the machine comprises an elongate chamber defining an ink reservoir, from which ink is delivered via a plurality of ports to the surface of a printing roller. Metering of the ink to a printable film thickness is achieved by subsequent inter roller actions. Different coloured ink supplies are attached to the opposing ends of the elongate chamber, which is further provided with a plug, which, being circular (regular) in cross section, is a close but sliding fit therein. When ink from a primary supply is being used the plug sits at the end of the elongate chamber distal the primary ink supply, when a colour change is required, the primary ink supply is shut off and ink is pumped in from the secondary ink supply. This has the effect of driving the plug to the opposite end of the elongate chamber, thus purging it of the primary ink. The system described is a piston driven pressurised ink delivery system, which would appear to offer a reasonably good solution given the nature of the printing process it is designed to serve, however, as will be readily apparent to a person skilled in the art, such a system would be entirely unworkable in a conventional ink chamber system (such as Flexographic or Gravure), which is essentially a zero pressure system with irregular and constantly changing chamber cross section, since any attempt to utilise ink pressure to drive the plug the length of the chamber would cause a system failure in terms of either ink escape via one of the end seals or via the sealing contact between doctor blade and engraved cylinder, furthermore, because of the changing chamber cross section, all attempts to propel such a plug either by pressurisation or by vacuum would inevitably fail.

In the foregoing description, a number of terms will be used to simplify understanding; however, the following lexicon should guide the person skilled in the art as to what those terms are intended to mean:

The term "ink" is intended to incorporate not only standard printing inks, but also other liquid based media, be they solutions, suspensions or liquid mixtures, said liquid media to include (but not be limited to) inks, glues, adhesives, lubricants, fragrances, and balms. It is also recognised that the term ink encompasses all types of printing inks, such as UV cured systems, air dried systems, IR dried systems and any other type of print system.

The term "engraved cylinder" is intended to encompass Anilox cylinders, coating cylinders and gravure cylinders, indeed any of the engraved cylinders commonly used within the printing and coating industries.

Where end seals are described, they are described as flexible, disposable seal members, however it is recognised that it would be perfectly feasible to have end seals integrally formed with the ink chamber.

The term "primary inlet" has been used below, however, it is readily accepted and easily understood from the foregoing description, that whilst this is termed as an inlet, it is known and expected to also serve as an outlet when the chamber is being drained.

The term "ports" is used to refer to holes in the chamber profile, said holes being utilised as either inlets, outlets or both.

The term "shuttle" is not intended to be restrictive at all and merely refers to a movable member, said member being capable of reciprocal/oscillatory movement within an ink chamber or ink cavity. No inferences as to the form or shape of the member should be made as a result of it being termed a shuttle.

It is an object of the present invention to provide a system to remove most or substantially all of the residual ink from an ink chamber prior to post print washing, said ink chamber comprising an ink chamber profile provided with a space for ink, at least one inlet and at least one outlet, and with upper and lower doctor blade members detachably mounted on the ink chamber profile, said blades bounding an opening which, in operation, faces and engages with the outer circumference of an engraved cylinder and which extends over the length of the ink chamber profile, the ink chamber profile being sealed at its extremities by flexible seals, said ink chamber profile, end seals, doctor blades and engraved cylinder demarcating an ink cavity, characterised in that there is further provided a shuttle member within the ink cavity, said shuttle member being movable substantially along the entire length of the ink chamber profile in order to aid purging of residual ink from said ink cavity, said shuttle member further being provided with associated drive means to induce movement within said ink cavity.

Optionally said shuttle occupies substantially the entire cross sectional area of said ink cavity.

Preferably said shuttle occupies some or all of the lower half of the cross sectional area of said ink cavity.

Said shuttle preferably comprises a sledge member and a wiper member, said wiper optionally being disposable. Preferably said wiper member is constructed from a flexible material, allowing it to be compressed by the engraved cylinder as the doctor blades are worn away. Optionally said flexible material is the same flexible material from which the end seals are constructed. Optionally said flexible material is the same flexible polymeric material from which doctor blades can be produced.

Said drive means may comprise an invasive system, with respect to the ink cavity, said invasive means being either direct drive systems or indirect drive systems.

Direct Drive Systems Include:

Wire pull systems, with wires attached to either side of the shuttle member extending through the ink chamber profile proximal either end, allowing the shuttle to be drawn back and forth within the ink cavity. Optionally, wire pull systems whereby the draw wire remains inside the ink cavity, but is driven by mechanical means which project through the ink cavity wall, (such as sealed shafts and pulleys).

Push rod systems, with rods attached to either side of the shuttle member extending through the ink chamber profile proximal either end, allowing the shuttle member to be pushed back and forth within the ink cavity.

Screw systems, with a rotatable screw thread running the length of the ink cavity, mechanical drive means for the rotation of said screw thread extending externally of the ink chamber profile, and the shuttle comprising complementary thread means, whereby rotation of said screw thread initiates movement of the shuttle member.

The mechanisms for driving any of these systems can be selected from any of a wide range of known mechanisms ranging from simple, manual activation (i.e. pulling or pushing by hand), through a range of electrical, mechanical, pneumatic or hydraulic options. It will be readily appreciated that the exact nature of the drive is not strictly pertinent to the present invention, and will most likely be decided/dictated by on site criteria, such as the availability of power, compressed air etc, available space and expense.

Indirect Drive Systems Include:

Electrical drive, with power supplied to the shuttle member, via cabling passing into the ink cavity, the shuttle comprising integral, electrically driven propulsion means, said means acting mechanically against a track or rack, Electromagnetic drive, via linear induction motion, whereby power is supplied to the shuttle member, via cabling passing into the ink cavity, the shuttle comprising integral, electro-magnetic drive propulsion means inducing shuttle motion relative to a static reaction rod or track.

Pneumatic drive, with compressed air being supplied to the shuttle member, via pipework passing into the ink cavity, powering pneumatic drive means contained within the shuttle member.

Hydraulic drive, with hydraulic fluid being supplied to the shuttle member, via pipework passing into the ink cavity, powering hydraulic drive means contained within the shuttle member.

Said drive means preferably comprise a non-invasive system, whereby the integrity of the ink cavity is not compromised by the drive mechanism. Non-invasive systems include:

Electro-magnetic drive, via linear induction motion, whereby the shuttle comprises a permanent magnet adjacent tracks/reaction rods located externally of the ink cavity. Application of a current to the reaction rods induces movement in the permanent magnet.

Magnetic drive, whereby the shuttle member comprises one or more permanent magnets reacting with one or more permanent, semi-permanent or temporary magnets located outside the ink cavity associated with an external drive mechanism. As discussed above, with regards to direct, invasive drive systems, the exact nature of the drive is not strictly pertinent to the present invention, and will most likely be decided/dictated by on site criteria, such as the availability of power, compressed air etc, available space and expense, however, for the avoidance of doubt it is recognised that such an external drive could be selected from a wide range of known mechanisms ranging from simple, manual activation (i.e. pulling or pushing by hand), through a range of electrical, mechanical, pneumatic or hydraulic options.

The preferred drive means is a magnetic drive means whereby the shuttle member comprises a plurality of permanent magnets each adjacent one of a plurality of permanent, semi-permanent or temporary magnets associated with an external drive mechanism, such that the attractive forces between the two sets of magnets act to maintain location of the shuttle member relative to the position of the remote drive mechanism, if location is lost, the drive mechanism can seek and find the lost shuttle, increasing attractive effort to recapture the shuttle and proceed with cleaning operations or retreat to a safe or park position.

The linear arrangement of magnets within the shuttle and drive mechanism are such that the probability of loss of lateral location with respect to each other is dramatically reduced due to the doubling up of attractive and repulsive properties of the individual magnets.

Figure 6:
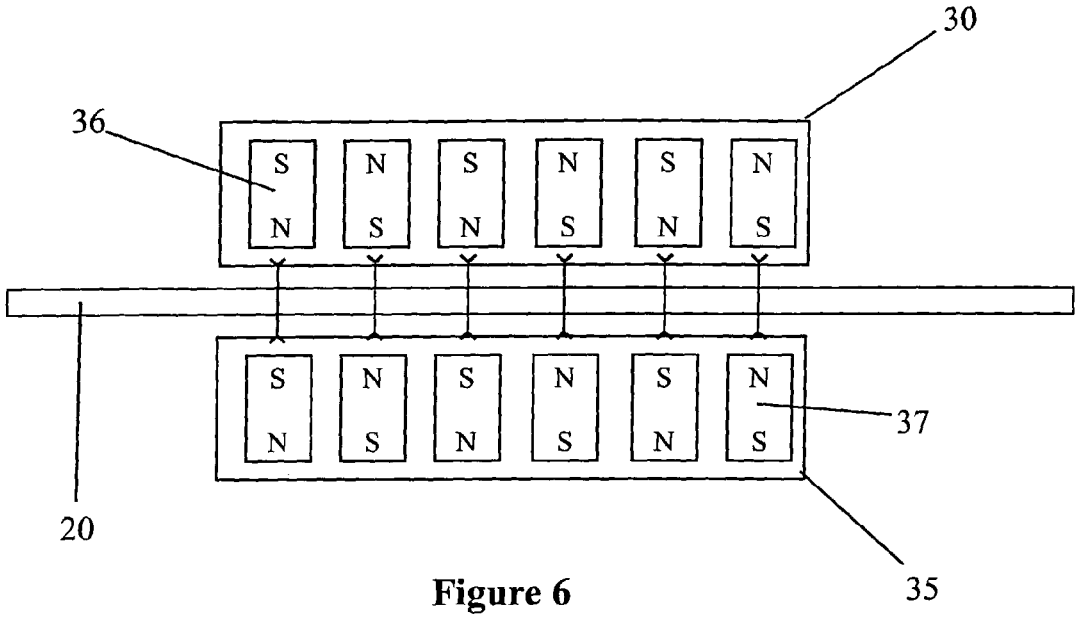
FIG. 6 is a schematic representation of an embodiment of the shuttle member and drive means of the present invention, with the shuttle member shown in a first position.
Figure 7:
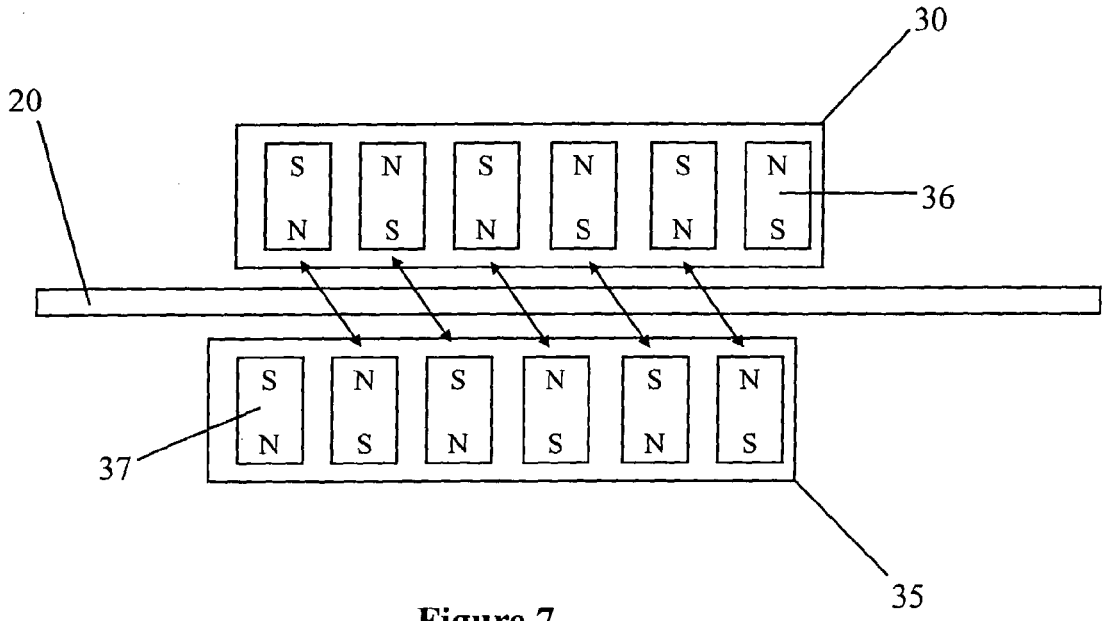
FIG. 7 corresponds to FIG. 6 with the shuttle member shown in a second position.

This combination of attractive and repulsive forces is best understood with reference to FIGS. 6 and 7. FIG. 6 shows an array of magnets 36 in the shuttle member 30, located immediately adjacent a similar array of magnets 37 in the drive mechanism 35, said shuttle 30 and drive mechanism sandwiching a portion of the ink chamber profile 20. The attractive forces between respective north and south poles are indicated with double tailed arrows.

FIG. 7 shows the effect of a movement of the shuttle 30, relative to the drive mechanism 35, the attractive forces weaken as the respective magnet arrays 36, 37 move out of alignment, however, as such movement necessarily attempts to bring like polarities into closer proximity, magnetic repulsion forces the shuttle 30 and the drive mechanism 35 back into their correct relative alignment.

The invention will be more easily understood with reference to the foregoing embodiments, which are given by way of example only and are in no way intended to limit the scope of the invention as claimed.

Figure 3:
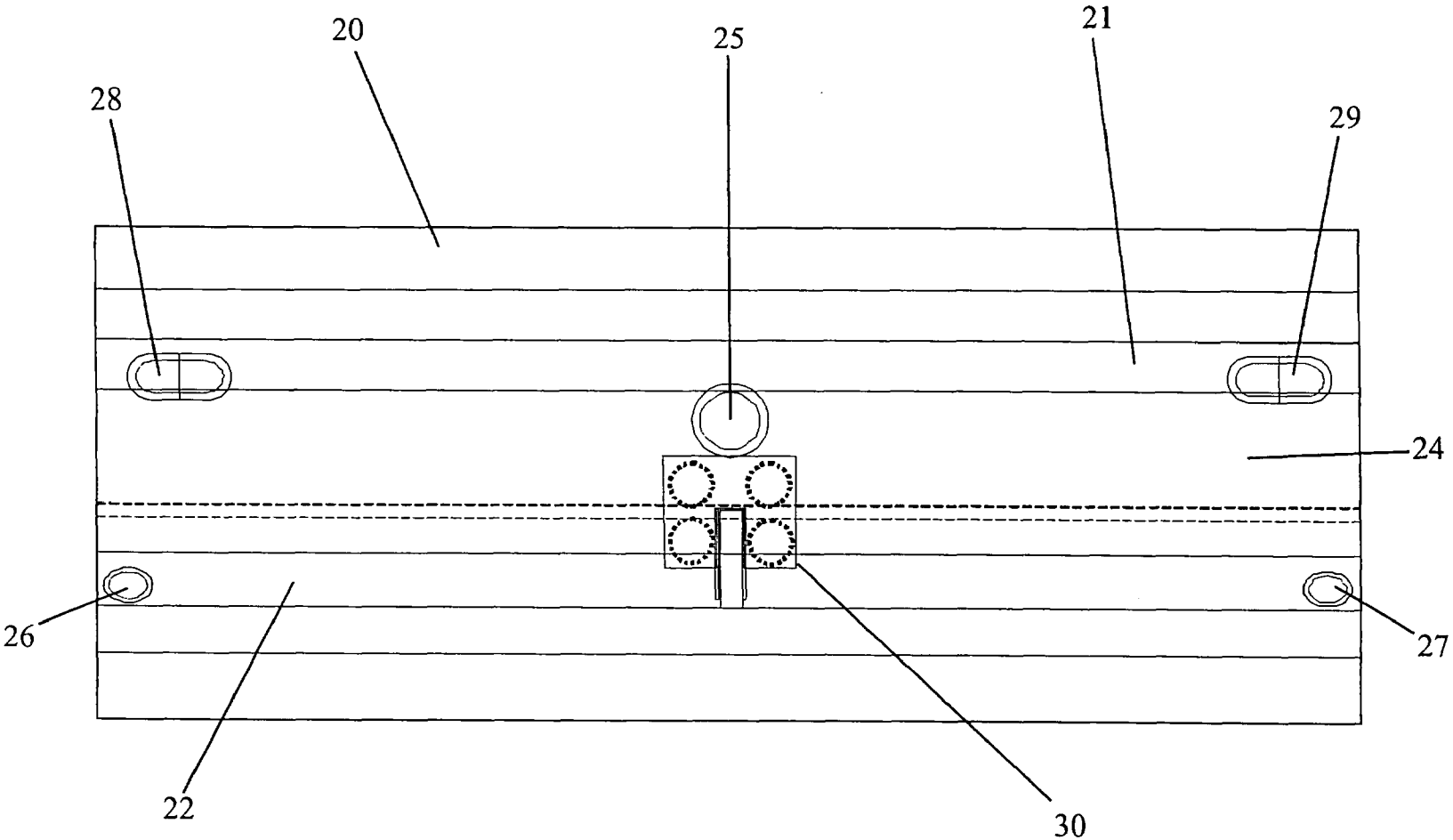
FIG. 3 is a schematic representation of a rear view of an embodiment of an ink chamber in accordance with the present invention.
Figure 4:
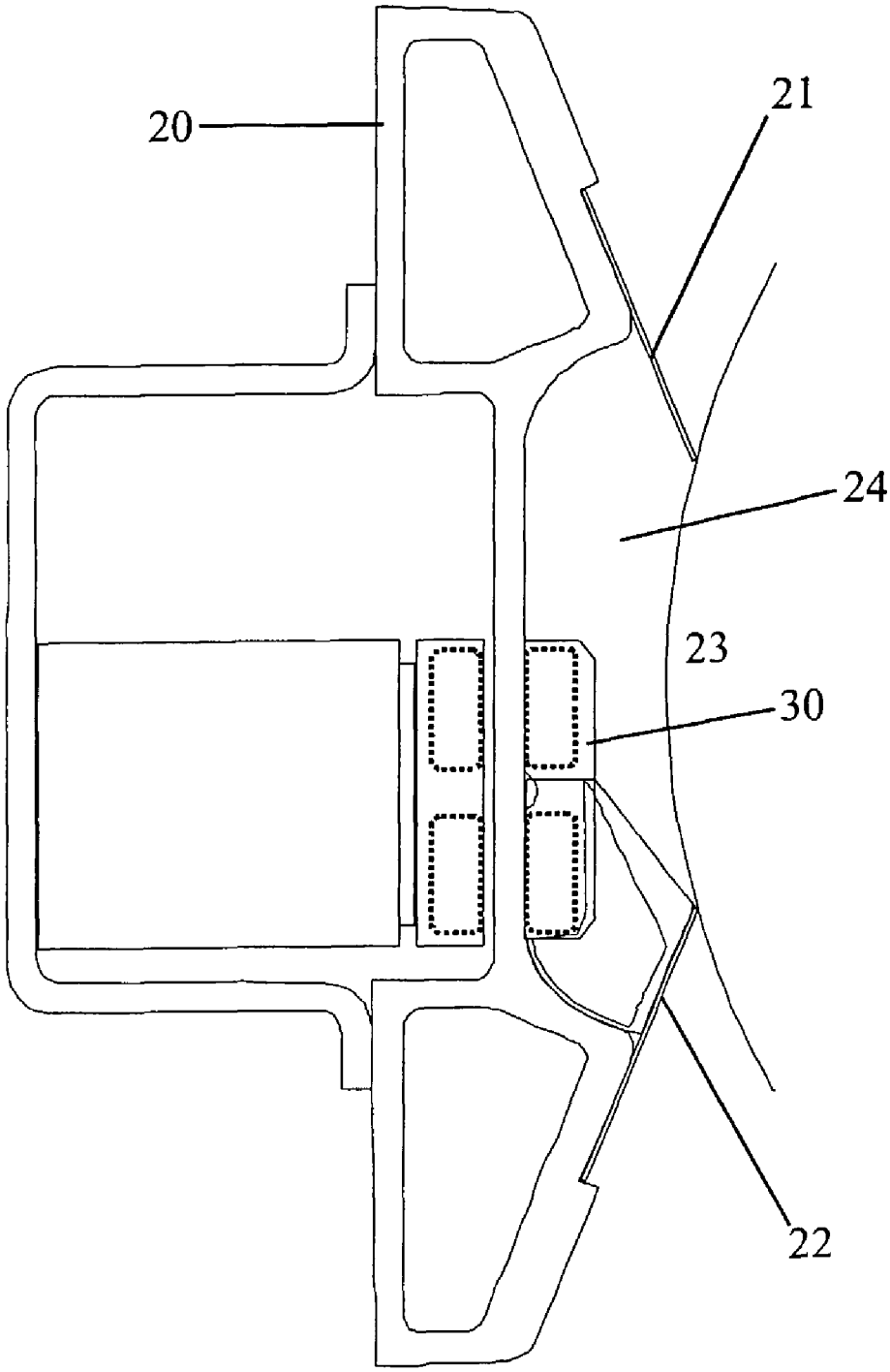
FIG. 4 is a sectioned side view of the ink chamber of FIG. 3.

Referring to FIGS. 3 and 4, in a preferred embodiment a system is provided for removing substantially all of the residual ink from an ink chamber prior to post print washing, said system comprising an ink chamber profile 20 provided with a space for an ink, with upper and lower doctor blade members 21, 22 detachably mounted on the ink chamber profile 20, said blades 21, 22 bounding an opening which, in operation, faces the outer circumference of an engraved cylinder 23 and which extends over the length of the ink chamber profile 20, the ink chamber profile 20 being sealed at its end faces by flexible seals, said ink chamber profile 20, end seals, doctor blades 21, 22 and engraved cylinder 23 demarcating an ink cavity 24. Said ink chamber profile 20 further comprises a primary inlet 25, located substantially in the middle of the ink chamber profile 20 in a longitudinal direction and above the mid point of the ink chamber profile 20 in a vertical direction. The ink chamber profile 20 is further provided with two ports 26, 27 each located at a respective end of the ink chamber profile 20, and two overflow outlets 28, 29 located substantially above said ports 26, 27. There is further provided a shuttle member 30 within the ink cavity 24, said shuttle member 30 being movable substantially along the entire length of the ink chamber profile 20 in order to aid purging of residual ink from said ink cavity 24.

Figure 5:
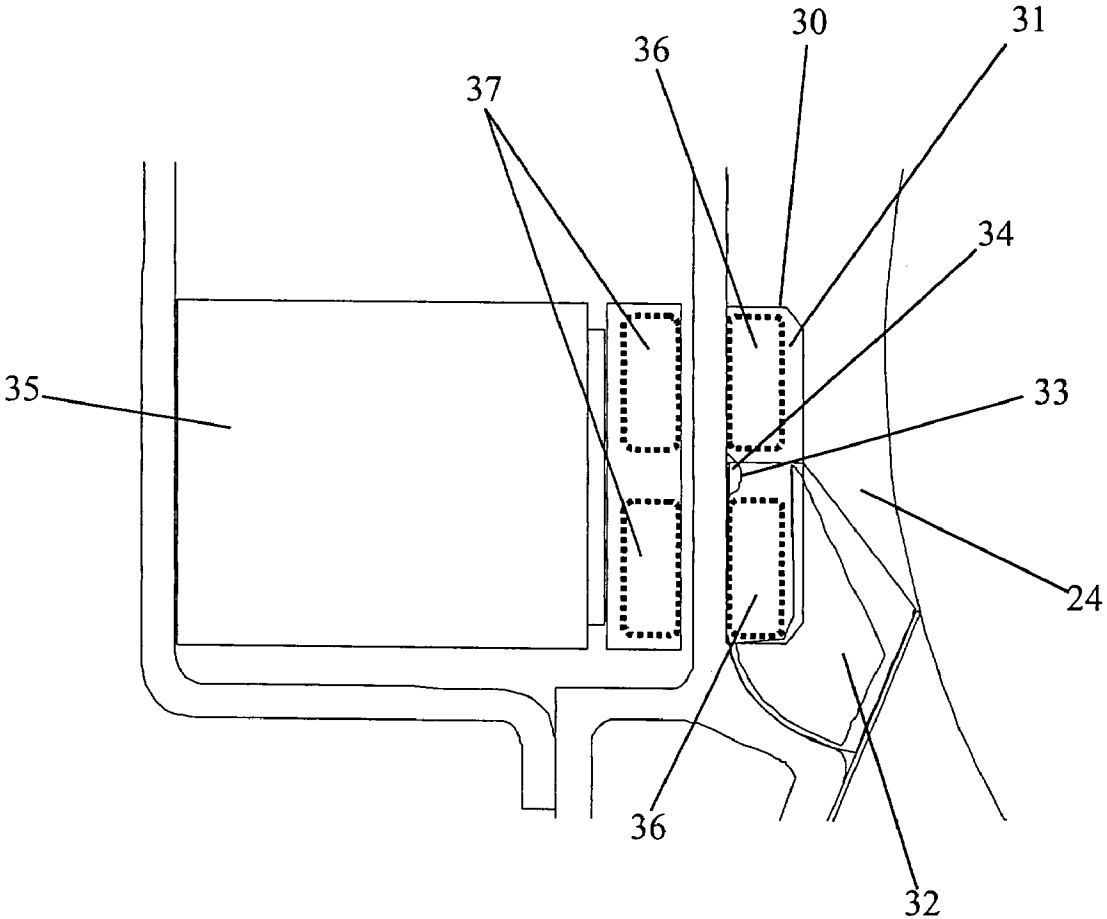
FIG. 5 is an enlarged view of part of FIG. 4 showing the shuttle member and drive mechanism of the present invention.

Referring now to FIG. 5, the shuttle member 30 comprises a sledge member 31 and a wiper member 32. The sledge member 31 has a recess 33 formed on its rear surface, said recess 33 forming a locating fit with a bead 34 running the length of the ink chamber profile. A drive mechanism 35 is provided externally of the ink cavity 24. Said sledge member 31 further comprises a plurality of magnets 36, with said drive mechanism 35 comprising a further plurality of magnets 37, said sets of magnets 36, 37 being arranged such that the poles of magnets 36 are adjacent the opposing poles of magnets 37. It will be readily appreciated that with this arrangement movement of the drive mechanism 35 will thus draw the shuttle member 30 along the inside of the ink cavity 24.

At the beginning of a printing operation, ink is pumped into the ink chamber 24 via primary inlet 25 and optionally also via ports 26, 27 at a rate greater than it is being used by the print operation, such that the ink cavity 24 fills with ink until such time as the ink level reaches the overflow outlets 28, 29, at which point excess ink is drained from the ink chamber 24, via outlets 28, 29. The drive mechanism 35 can be activated either intermittently or continuously during the printing process causing the shuttle member 30 to agitate the ink held within the ink cavity 24, thereby ensuring ink homogeneity throughout the print run.

At the end of the print run, the pumping of ink to both primary inlet 25 and ports 26, 27 is terminated and ink is allowed to drain back through the inlet and ports to the ink reservoir. The residual ink remaining in the ink cavity 24 is then urged towards the ports 26, 27 via a gentle oscillation of the shuttle member 30, initiated via the drive mechanism 35.

This system offers several benefits over and above the existing ink chamber systems. Firstly, the provision of the ports 26, 27 introduces additional turbulence to the ink cavity 24, thereby reducing the risk (and subsequent size of) dead zones within the ink cavity 24, delivering a more homogeneous ink to the engraved cylinder. Secondly, oscillation, either intermittent or continuous, of the shuttle member 30 within the ink cavity 24 further increases the homogeneity of the ink during printing operations. Finally, at the conclusion of a particular print job, the shuttle 30 can be used to purge the vast majority of residual ink from the ink cavity 24, returning it to the ink reservoir, thereby reducing not only costs associated with ink wastage, but also reducing the costs associated with and time taken to clean the ink chamber prior to re-use and also the costs associated with the cleaning/filtering of waste products prior to release into the environment.

In a second embodiment of the present invention, there is provided a system comprising an ink chamber profile provided with a space for an ink, with upper and lower doctor blade members detachably mounted on the ink chamber profile, said blades bounding an opening which, in operation, faces the outer circumference of an engraved cylinder and which extends over the length of the ink chamber profile, the ink chamber profile being sealed at its end faces by flexible seals, said ink chamber profile, end seals, doctor blades and engraved cylinder demarcating an ink cavity. Said ink chamber profile further comprises an inlet, located substantially in the middle of the ink chamber profile in a longitudinal direction and towards the bottom of the ink chamber profile in a vertical direction. The ink chamber profile is further provided with two overflow outlets located proximal the ends of the ink chamber profile in the upper portions thereof (for reference, the reader is directed to FIGS. 1 & 2 and their accompanying description within this specification). There is further provided a shuttle member within the ink cavity, said shuttle member being movable substantially along the entire length of the ink chamber profile in order to aid purging of residual ink from said ink cavity.

The shuttle member comprises a sledge portion and a wiper portion, said wiper portion being a sacrificial and disposable member. There are wires attached to either side of the sledge portion of said shuttle member, said wires extending through the ink chamber profile proximal either end, allowing an operator to move the shuttle back and forth within the ink cavity by pulling the wires in one or other direction.

In operation, this embodiment functions in substantially the same manner as the system described in the first embodiment, except that ink is urged out through the solitary inlet and also out through the overflow outlets.

A third embodiment differs from the second embodiment only in that said wires attached to either side of the sledge portion of said shuttle member do not exit the ink cavity, instead running around a pair of pulleys located within said ink cavity. Said pulleys are then driven via one or more sealed drive shafts which project through the wall of the ink chamber profile allowing an operator to move the shuttle back and forth within the ink cavity by applying rotation to one or more of said one or more drive shafts.

The invention claimed is:

1. A system to remove most or substantially all of the residual ink from an ink chamber prior to post print washing, said ink chamber comprising an ink chamber profile provided with a space for ink, at least one inlet and at least one outlet, and with upper and lower doctor blade members detachably mounted on the ink chamber profile, said blades bounding an opening which, in operation, faces and engages with the outer circumference of an engraved cylinder and which, extends over the length of the ink chamber profile, the ink chamber profile being sealed at its extremities by flexible seals, said ink chamber profile, end seals, doctor blades and engraved cylinder demarcating an ink cavity, characterized in that there is further provided a shuttle member within the ink cavity, said shuttle member being movable substantially along the entire length of the ink chamber profile in order to aid purging of residual ink from said ink cavity, said shuttle member further being provided with associated drive means to induce movement within said ink cavity, wherein said shuttle member occupies substantially the entire cross sectional area of said ink cavity.

2. A system according to claim 1 wherein said drive means comprise a non-invasive system, with respect to the ink cavity, said non-invasive system being selected from the group comprising:

a. electro-magnetic drive, via linear induction motion, whereby the shuttle member comprises a permanent adjacent tracks/reaction rods located externally of the ink cavity, application of a current to the reaction rods inducing movement in the permanent magnet;

b. magnetic drive, whereby the shuttle member comprises one or more permanent magnets reacting with one or more permanent, semi-permanent or temporary magnets located outside the ink cavity associated with an external drive mechanism.

3. A system according to claim 1 wherein said drive means comprise an invasive system, with respect to the ink cavity, said invasive means being selected from the group comprising direct drive systems and indirect drive systems.

4. A system according to claim 3 wherein said drive system is a direct drive system, said direct drive system being selected from the group comprising:

a. wire pull systems, with wire attached to either side of the shuttle member extending through the ink chamber profile proximal either end, allowing the shuttle member to be drawn back and forth within the ink cavity;

b. wire pull systems whereby the draw wire remains inside the ink cavity, but is driven by mechanical means which project through the ink cavity wall;

c. push rod systems, with rods attached to either side of the shuttle member extending through the ink chamber profile proximal either end, allowing the shuttle member to be pushed back and forth within the ink cavity;

d. screw systems, with a rotatable screw thread running the length of the ink cavity, mechanical drive means for the rotation of said screw thread extending externally of the ink chamber profile, and the shuttle member comprising complementary thread means, whereby rotation of said screw thread initiates movement of the shuttle member.

5. A system according to claim 3 wherein said drive system is an indirect drive system, said indirect drive system being selected from the group comprising:

a. electrical drive, with power supplied to the shuttle member, via cabling passing into the ink cavity, the shuttle member comprising integral, electrically driven propulsion means, said means acting mechanically against a track or rack;

b. electro-magnetic drive, via linear induction motion, whereby power is supplied to the shuttle member, via cabling passing into the ink cavity, the shuttle member comprising integral, electro-magnetic drive propulsion means inducing shuttle motion relative to a static reaction rod or track;

c. pneumatic drive, with compressed air being supplied to the shuttle member, via pipework passing into the ink cavity, powering pneumatic drive means contained within the shuttle member;

d. hydraulic drive, with hydraulic fluid being supplied to the shuttle member, via pipework passing into the ink cavity, powering hydraulic drive means contained within the shuttle member.

6. A system to remove most or substantially all of the residual ink from an ink chamber prior to post print washing, said ink chamber comprising an ink chamber profile provided with a space for ink, at least one inlet and at least one outlet, and with upper and lower doctor blade members detachably mounted on the ink chamber profile, said blades bounding an opening which, in operation, faces and engages with the outer circumference of an engraved cylinder and which extends over the length of the ink chamber profile, the ink chamber profile being sealed at its extremities by flexible seals, said ink chamber profile, end seals, doctor blades and engraved cylinder demarcating an ink cavity, characterized in that there is further provided a shuttle member within the ink cavity, said shuttle member being movable substantially along the entire length of the ink chamber profile in order to aid purging of residual ink from said ink cavity, said shuttle member further being provided with associated drive means to induce movement within said ink cavity, wherein said shuttle member further comprises a sledge member and a wiper member.

7. A system according to claim 6, wherein said shuttle member occupies some or all of the lower half of the cross sectional area of said ink cavity.

8. A system according to claim 6, wherein said wiper member is disposable.

9. A system according to claim 6, wherein said wiper member is constructed from a flexible material.

10. A system according to claim 6, wherein said drive means comprise an invasive system, with respect to the ink cavity, said invasive means being selected from the group comprising direct drive systems and indirect drive systems.

11. A system according to claim 10, wherein said drive system is a direct drive system, said direct drive system being selected from the group comprising:

a. wire pull systems, with wire attached to either side of the shuttle member extending through the ink chamber profile proximal either end, allowing the shuttle member to be drawn back and forth within the ink cavity;

b. wire pull systems whereby the draw wire remains inside the ink cavity, but is driven by mechanical means which project through the ink cavity wall;

c. push rod systems, with rods attached to either side of the shuttle member extending through the ink chamber profile proximal either end, allowing the shuttle member to be pushed back and forth within the ink cavity;

d. screw systems, with a rotatable screw thread running the length of the ink cavity, mechanical drive means for the rotation of said screw thread extending externally of the ink chamber profile, and the shuttle member comprising complementary thread means, whereby rotation of said screw thread initiates movement of the shuttle member.

12. A system according to claim 10, wherein said drive system is an indirect drive system, said indirect drive system being selected from the group comprising:

a. electrical drive, with power supplied to the shuttle member, via cabling passing into the ink cavity, the shuttle member comprising integral, electrically driven propulsion means, said means acting mechanically against a track or rack;

b. electro-magnetic drive, via linear induction motion, whereby power is supplied to the shuttle member, via cabling passing into the ink cavity, the shuttle member comprising integral, electro-magnetic drive propulsion means inducing shuttle motion relative to a static reaction rod or track;

c. pneumatic drive, with compressed air being supplied to the shuttle member, via pipework passing into the ink cavity, powering pneumatic drive means contained within the shuttle member;

d. hydraulic drive, with hydraulic fluid being supplied to the shuttle member, via pipework passing into the ink cavity, powering hydraulic drive means contained within the shuttle member.

13. A system according to claim 6, wherein said drive means comprise a non-invasive system, with respect to the ink cavity, said non-invasive system being selected from the group comprising:

a. electro-magnetic drive, via linear induction motion, whereby the shuttle member comprises a permanent adjacent tracks/reaction rods located externally of the ink cavity, application of a current to the reaction rods inducing movement in the permanent magnet;

b. magnetic drive, whereby the shuttle member comprises one or more permanent magnets reacting with one or more permanent, semi-permanent or temporary magnets located outside the ink cavity associated with an external drive mechanism.

* * * * *